United States Patent [19]

Rousseau

[11] 4,424,692

[45] Jan. 10, 1984

[54] BRAMAH OR PIN LOCK

[75] Inventor: Raymond Rousseau, Montigny le Bretonneux, France

[73] Assignee: Fichet-Bauche, France

[21] Appl. No.: 288,295

[22] Filed: Jul. 30, 1981

[30] Foreign Application Priority Data

Aug. 5, 1980 [FR] France ..... 80 17305

[51] Int. Cl.[3] ..... E05B 27/08

[52] U.S. Cl. ..... 70/363; 70/378; 70/403

[58] Field of Search ..... 70/363, 364 R, 364 A, 70/358, 276, 407, 376, 378, 403, 404

[56] References Cited

U.S. PATENT DOCUMENTS 1,589,256 6/1926 Sproth ..... 70/407
3,654,782 4/1972 Heimann ..... 70/276

FOREIGN PATENT DOCUMENTS 552963 3/1923 France .
1563861 3/1969 France .
250600 6/1948 Switzerland .

OTHER PUBLICATIONS

International Search Report, FA 253 882, Mar. 24, 1981.

*Primary Examiner*—Robert L. Wolfe
*Attorney, Agent, or Firm*—Kane, Dalsimer, Kane, Sullivan and Kurucz

[57] ABSTRACT

A lock with pins mobile in translation and/or in rotation about their longitudinal axes, wherein the pins are housed into cylindrical passages of a rotatable cylinder and are brought by a key in positions such that cut-outs of these pins are in alignment with a passage annular path formed in a blocking fixed crown of the lock, for allowing the rotation of the cylinder and the opening of the lock.

22 Claims, 17 Drawing Figures

BRAMAH OR PIN LOCK

FIELD AND BACKGROUND OF THE INVENTION

This invention relates to a Bramah or pin lock actuatable by a key.

Pin or Bramah locks are known, which comprise a rotor or cylinder housed in a stator or lock fixed body. To each notch (touch or cut-out) on the key corresponds a first element of a pin assembly, housed in the cylinder and associated with a second pin element housed in the body, and the unblocking is obtained at the junction surface between the rotor and the stator when the junction between these two pin elements is coincident with said surface and when the first pin element is brought by the key corresponding touch or cut-out in a predetermined longitudinal and angular position.

Thus, to each touch or cut-out of the key are associated at least two pin elements, hence the high cost of the lock.

OBJECTS AND SUMMARY OF THE INVENTION

The object of the invention is a pin or Bramah lock which is not exhibiting such a disadvantage.

To this effect, it provides a lock of the type comprising a stator or body, a rotor or cylinder rotatably mounted about its longitudinal axis in the body, a bolt operating member which is rotatably attached to the cylinder and pins adapted for allowing or preventing the rotation of the cylinder according to their respective positions in the housings formed in the cylinder and the body, the housings formed in the cylinder communicating with an axial key passage of the cylinder so that the pins are displaceable in said housings by notches of the key when said key is introduced into the key passage, wherein the improvement consists in that the key notches correspond to pins formed as units which are each permanently engaged in a housing of the cylinder and in a housing of the body, and wherein the pin housings formed in the body are interconnected by an annular path in which pass the pins when the cylinder is rotating, said annular path being formed with projections or contractions adapted for cooperating with cut-outs in the pins.

Advantageously, to each notch of the key corresponds a single unitary pin, thereby decreasing the cost of the lock and facilitating its mounting.

In an embodiment where the pins are orineted parallel to the rotation axis of the cylinder, the end portion of each pin, situated in the cylinder housing, is formed with a helical groove adapted for cooperating with a radial stud of the key, formed in front of a radial shoulder which is adapted for abutting against the end frontal face of the pin and to displace it in translation when said key is introduced in the lock.

In this embodiment, the pin can be angularly displaced over 180° about its axis, in one direction or in the other, from a reference position, thereby allowing chosing the angular displacement of a pin amongst a very large number of possible values.

According to another embodiment of the invention where the pins are displaceable in translation and radially oriented relative to the rotation axis of the cylinder, their axes being in a same plane perpendicular to said rotation axis, the end frontal face of each pin facing the key passage comprises an eccentric stud parallel to the pin axis and adapted for being engaged in an oblique groove of the key when said key is introduced in the lock.

With this arrangement, it is possible not only to displace the pins in translation, but to drive them in rotation about their axes over angles between 0° and a value slightly smaller than 90°, in one direction or the other, from an initial position, thereby offering also the possibility of chosing the rotation angle of a pin amongst a very large number of values.

BRIEF DESCRIPTION OF THE DRAWINGS

In the following description which is given by way of example, reference is made to the accompanying drawings wherein.

DETAILED DESCRIPTION OF THE EMBODIMENTS

Figure 1:
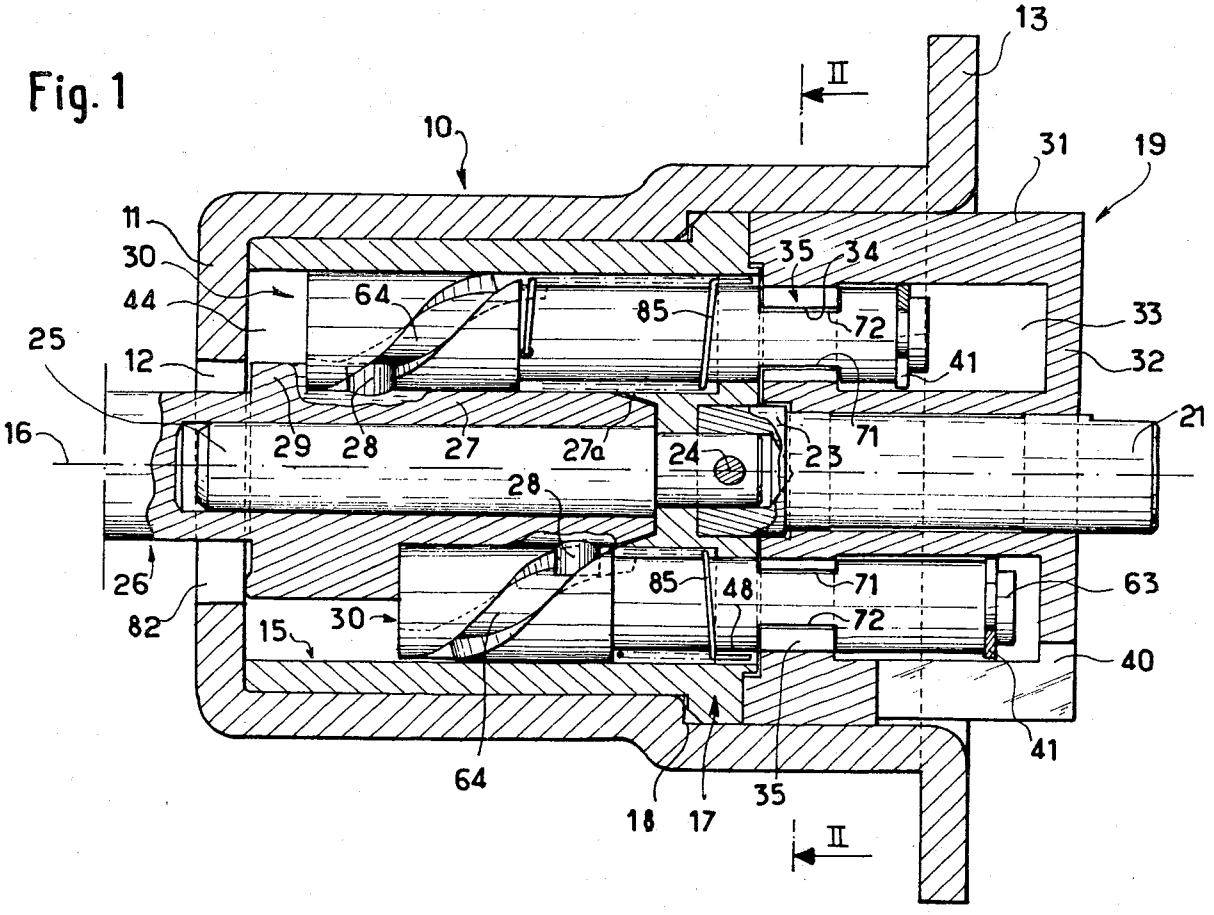
FIG. 1 is an axial sectional view of a first embodiment of the lock according to the invention.
Figure 3:
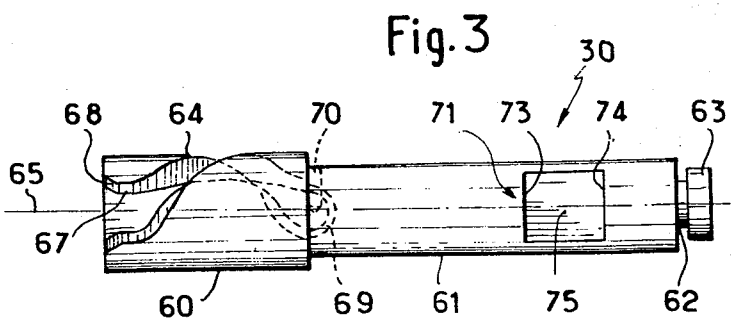
FIG. 3 is a plan view of a pin of the lock of FIGS. 1 and 2.
Figure 4:
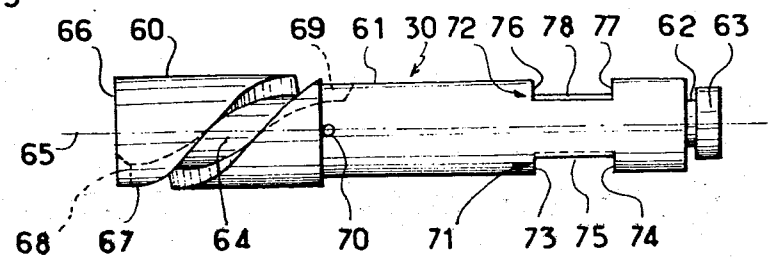
FIG. 4 is a top view of the pin of FIG. 3.
Figure 2:
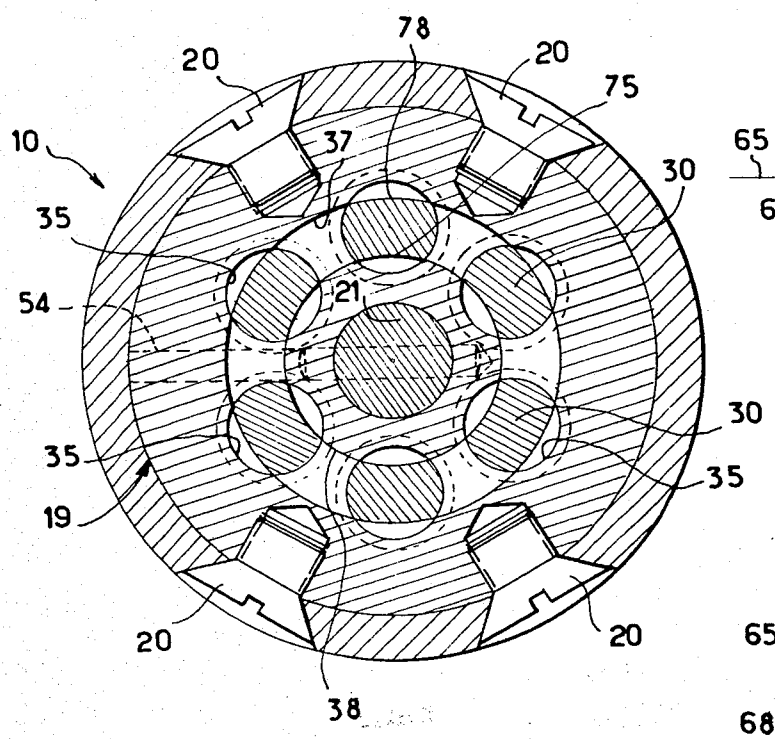
FIG. 2 is a sectional view along line II—II of FIG. 1.

Reference is first made to FIGS. 1 through 10 which show a first embodiment of a lock according to the invention.

Said lock comprises a body or stator 10, of substantially tubular cylindrical shape, one end of which presents a bottom wall 11 formed with a key inlet 12, and the other end of which is formed with a fixation annular flange 13, extending radially towards the outside. A rotor or cylinder 15 is housed inside body 10 and is rotatably mounted about its longitudinal axis 16, which is coincident with the longitudinal axis of body 10. The rear end of the cylinder is substantially in contact with the bottom wall 1 of body 10, and its front end is formed with an annular shoulder 17, to which corresponds a shoulder 18 of body 10, and which is substantially in engagement with the rear end of a blocking crown 19 partly introduced into body 10 and fixed to said body by screws 20.

Through the blocking crown extends axially a shaft 21, forming the operating member of one or several bolts, rotatably guided in an axial well 22 of crown 19, and the posterior end of which forms a head 23 introduced in a corresponding housing of cylinder 15 and rotatably connected to the latter by means of a transverse pin 24. The head 23 of shaft 21 is hollow and receives the end of a spindle 25, which is rotatably connected to cylinder 15 and to shaft 21 by means of the pin 24, and which extends in the prolongation of shaft 21 up to the key inlet 12 of body 10. The spindle 25 masks in part the key passage in body 10 so that it is more difficult to use picking tools from the key inlet 12 in order to attempt unblocking the lock.

A lock key 26 has a body or end portion 27, substantially tubular and cylindrical, with a frustoconical front end 27*a*, which is threaded onto spindle 25 inside cylinder 15 and which moves, by means of studs 28 and shoulders 29, pins 30 placed in housings of the cylinder 15 and of the blocking crown 19.

The blocking crown 19 (FIGS. 7 and 8) comprises a substantially cylindrical peripheral wall 31, a bottom wall 32 and the aforementioned central well 22 which extends axially through said crown 19 and which receives the bolt operating shaft 21. The peripheral wall 31 and said central well 22 define together an annular housing 33 receiving the anterior ends of pins 30. Said annular housing 33 extends over 360° about axis 16 of the blocking crown 19. Cylindrical passages 35, of axes parallel to axis 16, extend through the posterior bottom wall 36 of crown 19, and are regularly distributed about axis 16. In the example shown, said cylindrical passages 35 are six in number. They are interconnected by an annular path 34, formed into the thickness of wall 36, radially bounded by cylindrical wall sections 37 and 38 extending between the cylindrical passages 35. Each wall section 37 is concave, while each wall section 36 opposite a wall section 37 is convex. The radial distance between two corresponding wall sections 37 and 38 is smaller than the diameter of a cylindrical passage 35, so that the annular path 34 forms a narrowed portion between the various cylindrical passages 35. The annular path 34 and the annular housing 33 have the same median cylinder, shown by the center line and designated by reference numeral 39. The axes of the cylindrical passages 35 are contained into said median cylinder 39 and are parallel to axis 16.

The annular housing 33 opens outside the blocking crown 19 via a cut-out 40 of the peripheral wall 31 and of the bottom wall 32. Said cut-out 40 allows mounting circlips 41 at the end of pins 30, as will be later described.

Figure 6:
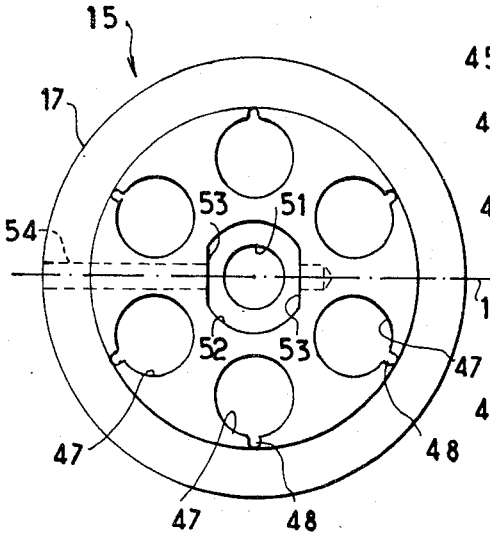
FIG. 6 is a right-hand side view of the cylinder of FIG. 5.
Figure 5:
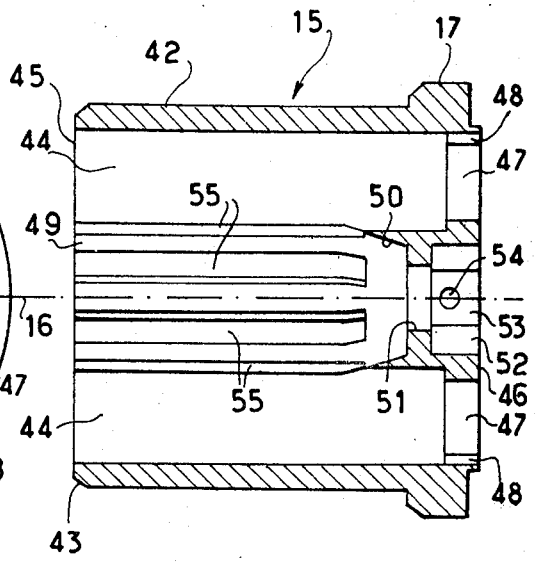
FIG. 5 is a longitudinal sectional view of the cylinder of lock of FIGS. 1 and 2.
Figure 7:
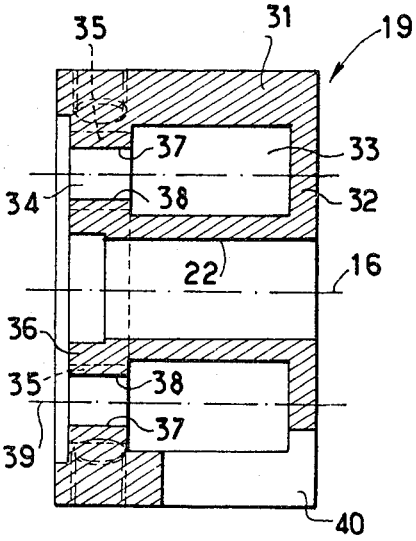
FIG. 7 is a longitudinal sectional view of the blocking crown which is part of the lock of FIGS. 1 and 2.
Figure 8:
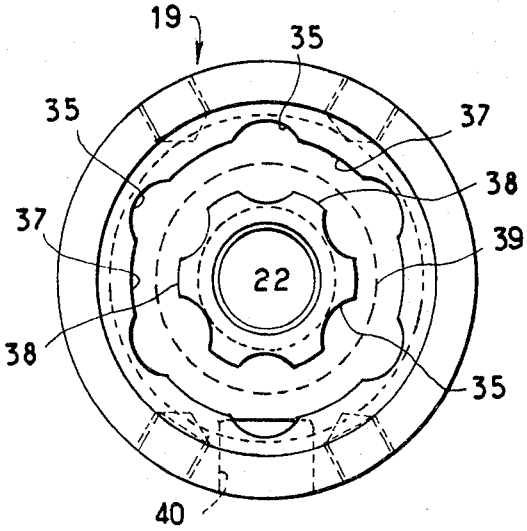
FIG. 8 is a left-hand side view of the blocking crown shown in FIG. 7.
Figure 9:
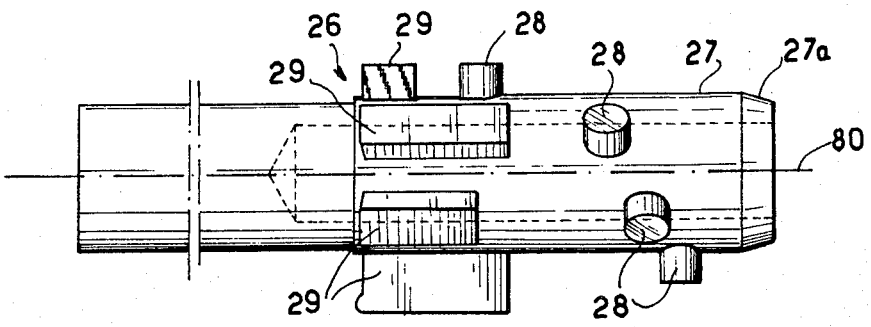
FIG. 9 shows schematically a key of the lock of FIGS. 1 and 2.
Figure 10:
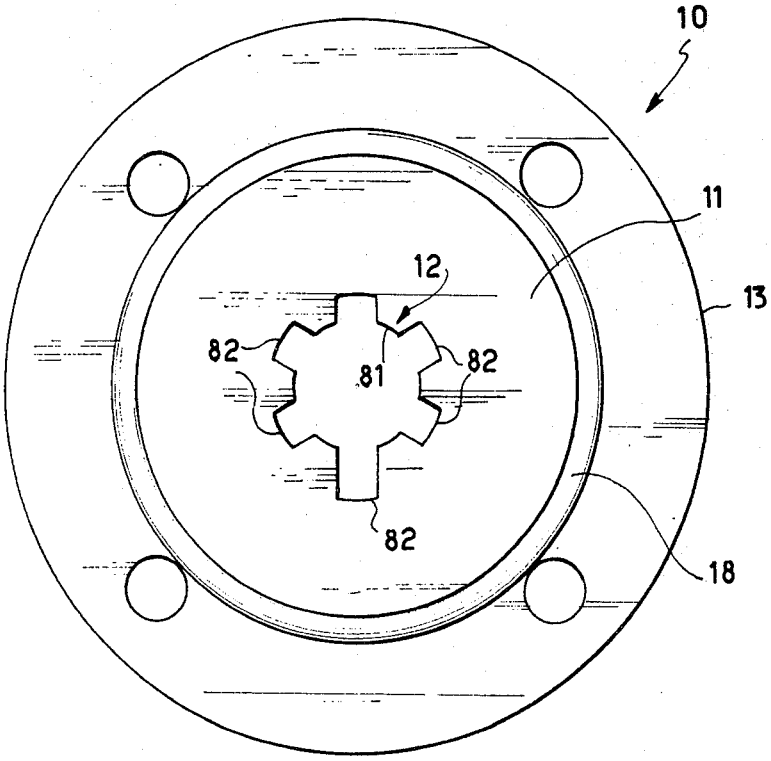
FIG. 10 is an end view of the body of the lock of FIGS. 1 and 2.
Figure 12:
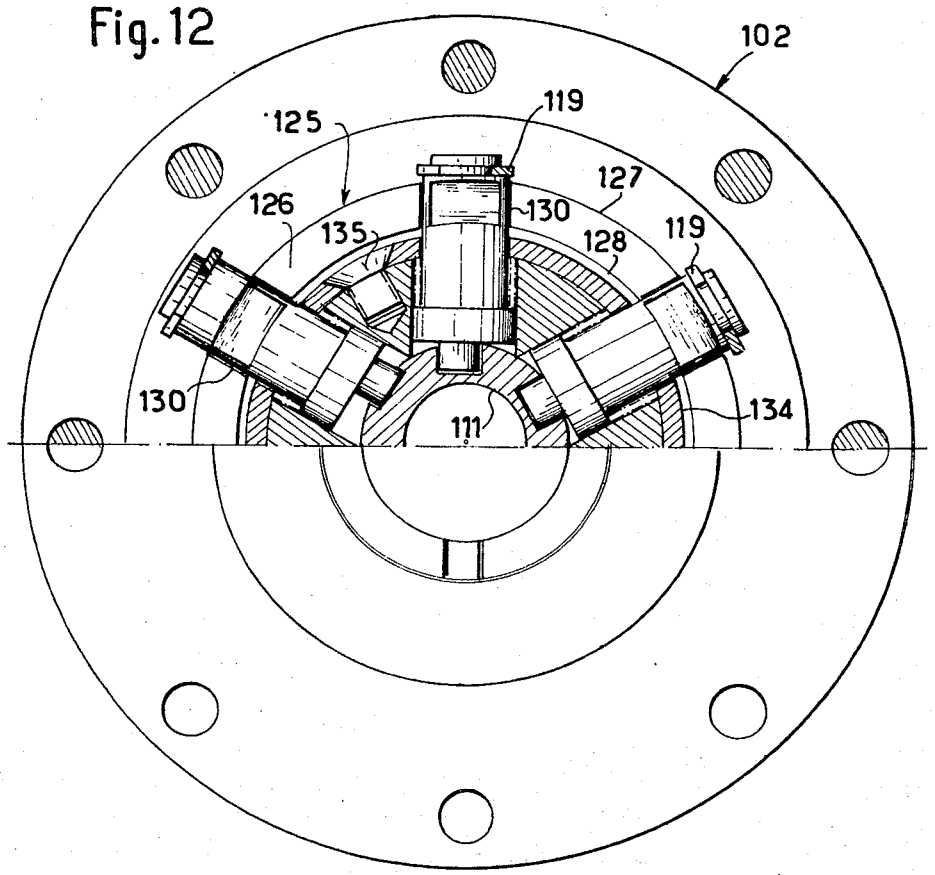
FIG. 12 is a half-view in transverse section along line XII—XII of FIG. 11 and a half-view from the outside of the lock of FIG. 11.
Figure 11:
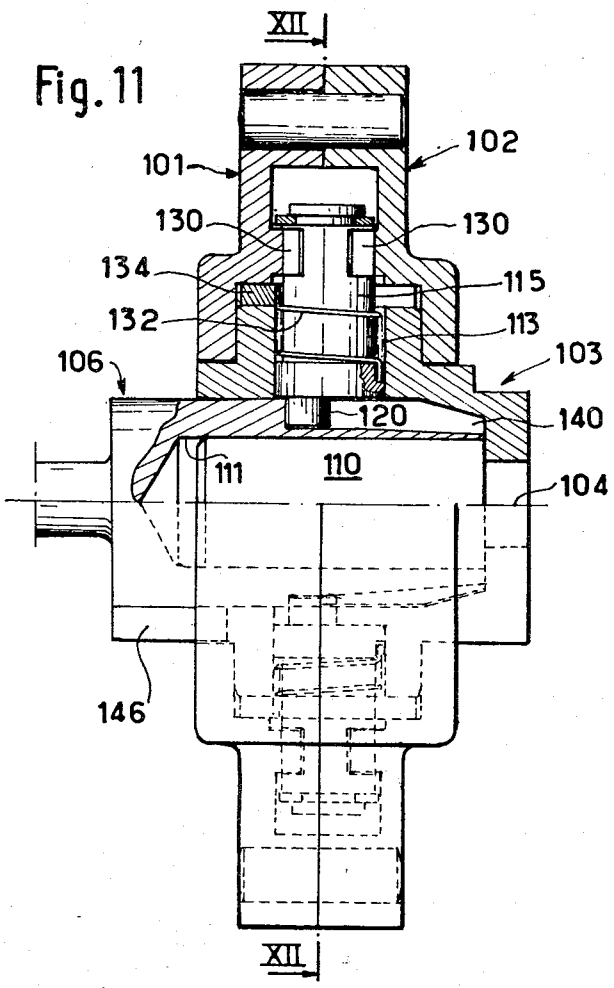
FIG. 11 is a half-view in axial section and a half-view from the outside of a second embodiment of the lock according to the invention.
Figure 14:
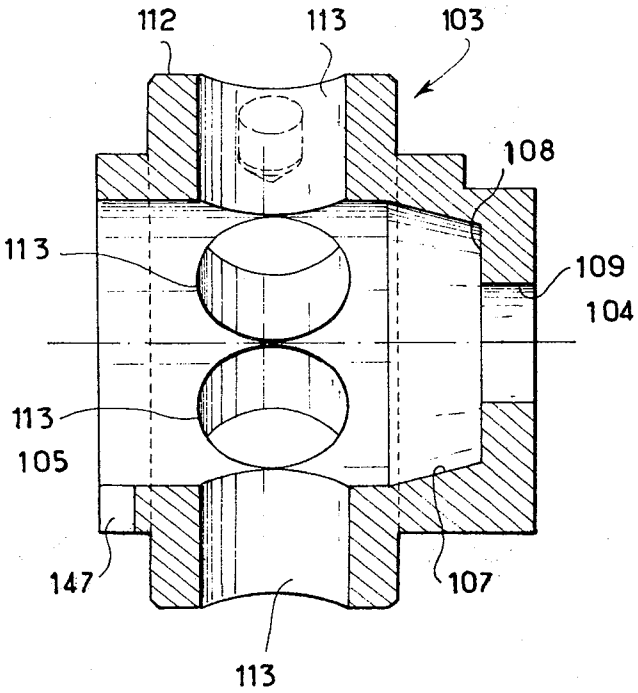
FIG. 14 is a plan view of the cylinder of the lock of FIG. 11.
Figure 13:
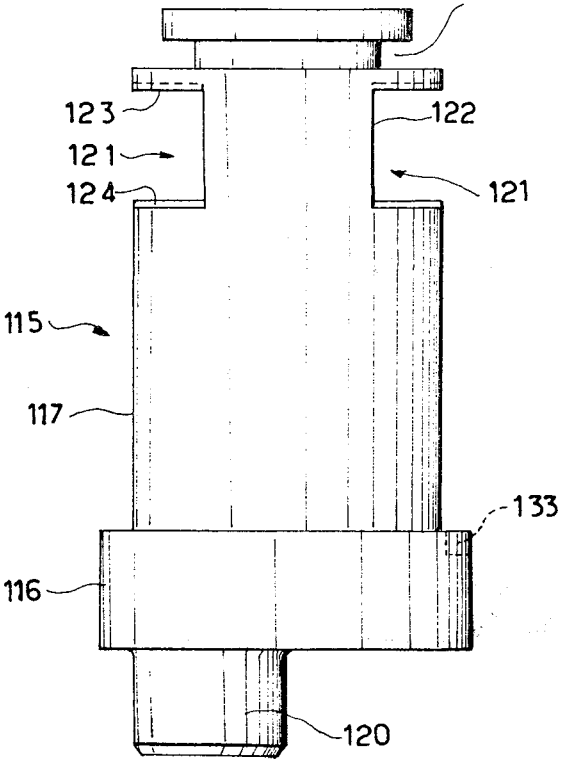
FIG. 13 is a plan view of a pin of the lock shown in FIG. 11.
Figure 15:
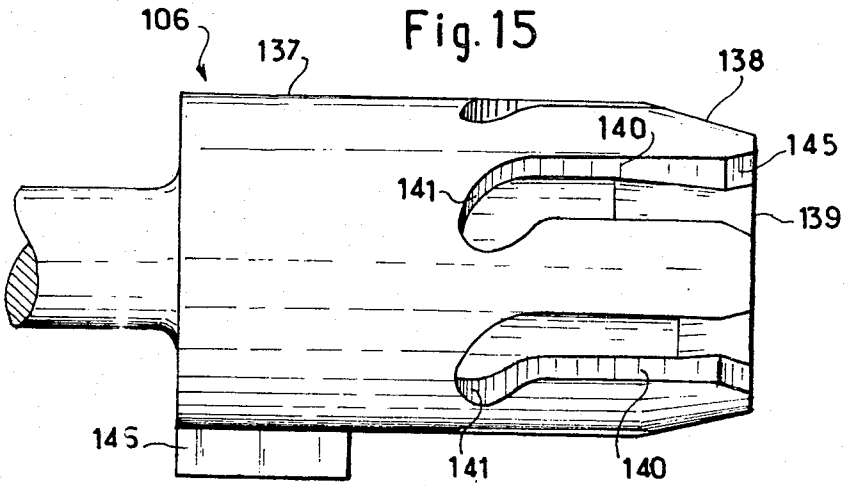
FIG. 15 is a plan view of the key of the lock of FIG. 11.
Figure 16:
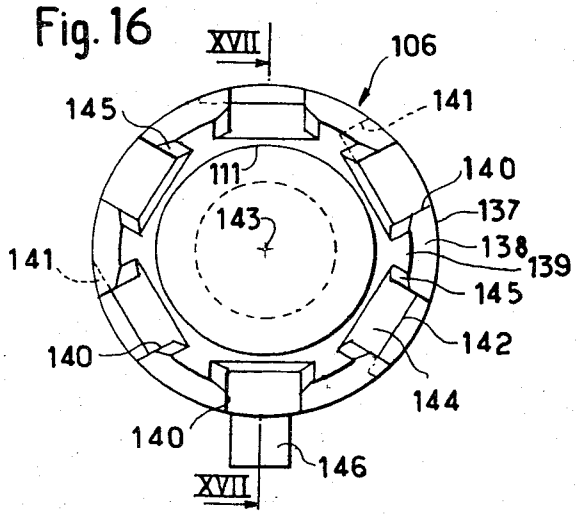
FIG. 16 is a right-hand side view of the key of FIG. 15.

The rotor 15, shown in more detail in FIGS. 5 and 6, comprises a cylindrical body 42, with a longitudinal axis 16 ending at one end by the aforementioned annular shoulder or edge 17. At its opposite end, the outer surface of the cylindrical body 42 is chamfered as is shown at 43. The body 42 is formed with six cylindrical passages 44, all identical, the longitudinal axes of which are parallel to axis 16, and radially distributed about axis 16 of rotor 5 at the same radial distance from said axis. The cylindrical passages 44 open freely at the end face 45 of rotor 15 comprising the chamfer 43, and they open at the opposite end face 46 via cylindrical passages 47 coaxial with passages 44 and of smaller diameter. Each cylindrical passage 47 is formed with a notch or groove 48, radially towards the outside of rotor 15.

The body 42 of rotor or cylinder 15 comprises also an axial passage or duct 49, starting from the end face 45 of body 42 and ending at a distance of the opposte face 46 via a frustoconical portion 50. A cylindrical portion 51 of small length connects said frustoconical portion 50 to a cylindrical duct 52, formed with two flat surfaces 53, provided for receiving the head 23 of the bolt operating shaft 21. A radial duct 54, forming a housing for pin 24, extends across the cylindrical body 42 and the two flat surfaces 53.

The axial cylindrical passage 53 is formed, over the major portion of its length, with longitudinal slits 55 communicating with the aforementioned cylindrical passages 44. Said longitudinal slits 55 provide a passage for the studs 28 and shoulders 29 of key 26 for driving the pins 30, and they are of appropriate size.

The pins 30 (FIGS. 3 and 4) comprise each a first cylindrical portion 60, a second cylindrical portion 61 coaxial to said first portion 60 and of smaller diameter, a third cylindrical portion 62 of small length, having a diameter less than that of the second portion 61, and a fourth cylindrical portion 63 having a diameter greater to that of the third portion 62 and smaller to that of the second portion 61. Between the cylindrical portions 61 and 63 is thus formed an annular groove provided for receiving a circlip 41 (FIG. 1). The first cylindrical portion 60 is formed with a helical groove 64 extending over about 180° about the longitudinal axis 65 of pin 30 and opening at the end face 66 of the first cylindrical portion 60 via a rectilinear groove portion 67 and a flared out portion 68. The helical groove 64 extends slightly beyond the first cylindrical portion 60 into the second cylindrical portion 61 and ends into a rounded portion 69.

The second cylindrical portion 61 is also formed with a radial blind hole 70, close to the first cylindrical portion 60, and two cut-outs 71 and 72, diametrically opposite, formed by transverse grooves of the periphery of the second portion 61. The groove 71 comprises two parallel side walls 73 and 74, perpendicular to the pin axis 65, and a concave curved bottom 75.

The other transverse cut-out or groove 72 comprises two plane side walls 76 and 77, perpendicular to the pin axis 65, and a curved bottom 78 which is convex and parallel to the concave bottom 75 of the other groove.

The pins 30 (six in number in the example shown) differ from each other only by the longitudinal arrangement of their cut-outs 71 and 72 and by the angular orientation of said cut-outs relative the helical groove 64.

The key of the lock according to the invention (FIG. 9) comprises, as hereabove indicated, a cylindrical body 27 ending into a frustoconical portion 27*a* whose shape is mating the frustoconical portion 50 of cylinder 15. The cylindrical body 27 comprises projecting radial studs 28, six in number, regularly distributed about the key axis 80, but longitudinally off-set along said axis relative to each other. Each stud 28 is formed in front of a key bit with which it is in longitudinal alignment. One of the key bits 29, for example the lower key bit in FIG. 9, has a radial dimension greater to that of the other key bits. Each key bit has a parallelepipedal rectangular shape, and has a definite longitudinal dimension, parallel to the key axis 80. The key bits 29 are different from each other by this longitudinal dimension, and the studs 28 are placed at different distances from the corresponding key bits.

The lock body 10 (FIG. 10) is formed in its bottom wall 11 with a key inlet 12 the shape of which corresponds to the contour of key 26, i.e. said key inlet is formed with an axial cylindrical passage 81 the circonference of which is formed with rectangular grooves 82 extending radially towards the outside. Said grooves 82 are regularly distributed at the periphery of the cylindrical passage 81 and have the same radial dimension, except one which has a greater dimension, adapted for receiving the key bit 29 having the largest radial dimension.

Said lock is assembled in the following manner:

The bolt operating shaft 21 and the spindle 25 are mounted into the rotor 15 by means of pin 24. The pins 30 are then placed each in a cylindrical duct 44 of rotor 15. The second cylindrical portion 61 of each pin is surrounded with a helical spring 85, one end of which is engaged into the radial hole 70 of said second cylindrical portion 61 and the other end of which is engaged into the notch or slit 48 of the corresponding cylindrical passage 47 of rotor 15. The ends of pins 30, opposite their first cylindrical portion 60, are introduced into the cylindrical holes 35 of the blocking crown 19. Then, the lock body 10 can be brought over the unit and fixed to the blocking crown by means of screws 20. By rotating the cylinder 15, the ends of the pins 30 can be brought in succession opposite the cut-out 40 of the blocking crown 19, in order to engage the circlips 41 in the annular grooves provided to this effect at the ends of the pins.

The lock operates as follows:

When the key 26 is not introduced in the lock, the pins 30 are pushed back by the springs 85 in the direction of the bottom wall 11 of the lock body 10. In this condition, the flared out portions 68 which are at the end of the helical grooves 64 of pins 30 are substantially opposite grooves 82 of the key inlet 12 of body 10.

When the key 26 is introduced into the lock through the key inlet 12, its tubular cylindrical body 27 is threaded onto the spindle 25, inside the axial cylindrical passage 49 of cylinder 15, and the various studs 28 of the key are each engaged into a flared out portion 68 of a helical groove. It is to be appreciated that the flared out portions 68 provide the possibility of making up for small positioning faults of the pins 30 returned by springs 85 towards the key inlet 12. As the key is being introduced into the lock, the studs 28 are moved in translation parallel to axis 16 in the direction of the blocking crown 19. Each stud 28 which is leaving the flared out portion 68 of a pin moves into the rectilinear groove portion 67, the effect of which is to angularly position the corresponding pin 30. The stud 28 then engages the helical groove 64, the rectilinear displacement of stud 28 causing a rotation of pin 30 about its longitudinal axis 65, the angle of rotation of the pin being determined by the distance between the stud 28 and the corresponding key bit 29. When the latter is bearing against the end face 66 of pin 30, it pushes pin 30 which moves in translation parallel to axis 16. Each pin 30 is then brought, once the key is completely introduced in the lock, to a longitudinal and angular position for which the curved bottoms 75 and 76 of its cut-outs 71 and 72 are in longitudinal and angular alignment with the sections of cylindrical wall 37 and 38 of the annular path 34 connecting the various cylindrical passages 35 of the blocking crown 19. Under such conditions, the pins 30 allow the rotation of the cylinder 15 relative to the blocking crown 19. This rotation of cylinder 15, caused by the rotation of key 26 about axis 16, is directly transmitted to the bolt operating shaft 21.

Reversely, when the key 26 is removed from the lock, the pins 30 are returned by springs 85 to their initial positions, so that their cut-outs 71 and 72 are no more in longitudinal and angular alignment with the walls of the annular path 34 of the blocking crown 19. In this condition, the pins 30 secure cylinder 15 against rotation relative to the blocking crown 19.

In order to unlock the lock, it will be appreciated that each pin has to be moved in longitudinal translation parallel to axis 16, until the cut-outs 71 and 72 are brought to the level of the annular path 34, and that it has to be moved in rotation about its longitudinal axis 65 until the bottoms 75 and 78 of its cut-outs are in alignment with walls 37 and 38 of the annular path 34.

The angle of rotation of a pin can be chosen at any value between 0° and +180°, or 0° and −180°, relative to a reference position. The number of different combinations which can be obtained with such pins is therefore infinite. Moreover, the pins 30 can be formed with extra cut-outs, which will not allow the passage via the annular path 34, but which will make the "prodding" of the lock even more difficult.

Reference is now made to FIGS. 11 through 17 representing a second embodiment of the invention, where the pins are oriented radially relative to the cylinder axis of rotation.

In this embodiment, the lock body is formed of two half-bodies 101 and 102, substantially identical, which are fixed one to the other by any appropriate means and which define together a cavity inside which the cylinder 103 is rotatably mounted about its longitudinal axis 104. The cylinder or rotor 103 extends across the two half-bodies 101 and 102 and is formed with a substantially cylindrical axial orifice 105 for the introduction of a key 106. Said cylindrical orifice 105 ends into a frustoconical narrowed portion 107 and an annular shoulder 108 oriented radially towards the inside and forming a key abutment. The cylinder 103 is also formed with a cylindrical axial orifice 109, opposite orifice 105, and allowing the disposition inside said orifice of an axial metallic spindle 110 adapted for penetrating into a corresponding blind boring 111 of key 106.

The cylinder 103 comprises between its ends an annular edge 112 of larger diameter, in which are formed six passages 113 of cylindrical shape, extending radially relative to axis 104 of the cylinder and regularly distributed about said axis. The axes of said six radial passages 113 are contained in one same plane perpendicular to axis 104 of cylinder 103. In said radial passages 113 are housed unitary pins 115 of general cylindrical shape, each comprising a cylindrical base 116, a cylindrical body 117 having a diameter slightly inferior to that of base 116, and an annular groove 118 for housing a circlip 119, formed at the end of the cylindrical body 117.

From the cylindrical base 116 depends longitudinally an eccentric cylindrical stud 120 adapted for being introduced into a groove of key 106, as will be explained hereafter.

The body 117 of each pin 115 is formed with two diametrically opposite cut-outs 121, symmetrical relative to the longitudinal axis of body 117. Each cut-out is formed by a transverse groove comprising a flat bottom 122 and two side walls 123 and 124 which are curved and parallel. The side wall 123 is concave, while the side wall 124 is convex.

Each half-body 101, 102 is formed, protruding on its inner face, with an annular path 125 comprising a plane face 126 and two parallel cylindrical faces 127 and 128, of axis 104. Said annular path is locally interrupted in six places by radial passages 130 with a cylindrical contour, adapted for receiving the bodies 117 of pins 115.

Each pin 115 is surrounded with a return helical spring 132, one end of which is engaged in a notch 133 of the cylindrical base 116 of the pin, and the other end of which is engaged into a notch or slit of an annular piece 134 surrounding the annular edge 112 of cylinder 103, and fixed to said edge via screws 135. This annular piece 134 is formed with semi-cylindrical cut-outs into which extend the bodies 117 of pins 115.

The key 106 (FIGS. 15 through 17) comprises a tubular cylindrical body 137 ending at its front end into a frustoconical portion 138 corresponding to the frustoconical narrowed portion 107 of the cylindrical orifice 105 of cylinder 103.

From the front end face 139 of key 106 extend six longitudinal grooves 140, cut into the peripheral surface of body 137, and ending each into an oblique portion 141 the axis of which forms a determined angle with the axis of the rectilinear groove 140, said angle being different from one groove to the other.

The bottoms of the rectilinear grooves 140 and of the associated oblique grooves 141 are at different distances from the key axis 143.

Figure 17:
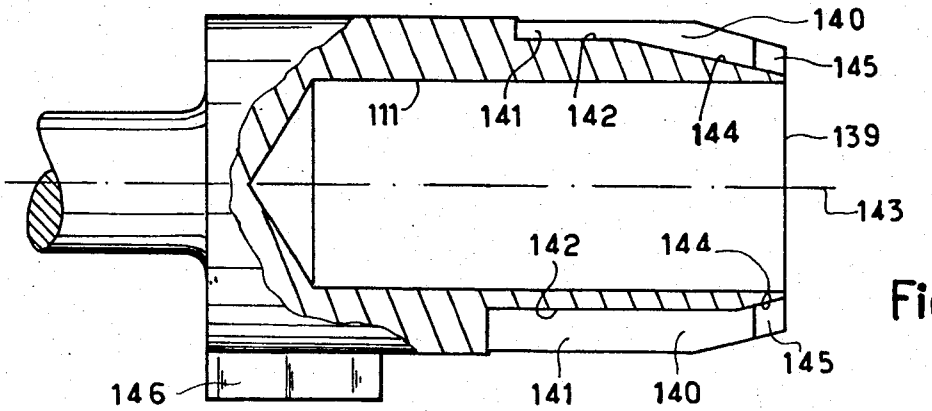
FIG. 17 is a sectional view along line XVII—XVII of FIG. 16.

As is shown in FIG. 17, the bottom of each oblique groove 141 and a first portion 142 of the bottom of each rectilinear groove 140 are parallel to axis 143 of key 106, while a second portion 144 of the bottom of each groove 140 is oblique relative to the axis 143 and comes closer to said axis at the level of the front face 139 of key 106.

Each rectilinear ridge opens at the front end face 139 of the key via a flared out portion 145.

From the key body 137 depends also, at its end opposite the front face 139, a protruding key bit 146 for the orientation of the key. The corresponding end of the cylindrical orifice 105 of cylinder 103 is formed with a radial notch or slit 147 adapted for receiving a portion of said key bit 146.

Said lock operates as follows:

When the key 106 is not introduced into the lock, the pins 115 are biased by springs 132 in the direction of axis 104 of cylinder 103. In this position, the eccentric studs 120 of pins 115 are in a determined angular position.

When the key 106 is introduced into orifice 105 of cylinder 103, each stud 120 of a pin 115 is engaged into a flared out portion 145 of a groove 140, 141 of key 106. The stud 120 is first centered in said groove and at the same time pushed back radially towards the outside when it bears against the oblique bottom 144 of the corresponding groove 140. When the stud 120 reaches the bottom 142 of the groove, it is maintained in a precise longitudinal position relative to axis 143. When stud 120 reaches then the beginning of the portion of the oblique groove 141, it is caused to turn about the longitudinal axis of the pin 115 in order to engage into said oblique groove portion 141. The result is a rotation of the pin 115 about its axis, over an angle the value of which is determined by the value of the angle between the axis of the oblique groove 141 and the axis of the rectilinear groove 140. The object of the translation radial displacement of each pin 115 and of its angular displacement about its axis is to bring its cut-outs 121 in alignment with the annular path 125 formed by each half-body 101, 102. When all the pins are thus correctly positioned, the cylinder can be driven in rotation about its axis 104 by using the key, said rotation being transmitted to a bolt operating member.

When the key is removed from the lock, all the pins 115 are returned by springs 132 to their initial position.

It will be appreciated that the translation displacement of each pin 115 is a function of the distance between the bottom 142 of each groove portion 141 and the key axis 143, and that the angular displacement of the pin is determined by the angle between the rectilinear ridge 140 and the oblique ridge portion 141. This angle is between 0° and a value slightly less than 90°, for example of the order of 80°, and can be positive or negative.

I claim:

1. A lock comprising a stationary body, a cylinder rotatably mounted about its longitudinal axis in the body, a bolt operating member which is rotatably attached to the cylinder, pins movable by a key in housings formed in the cylinder and the body, the housings formed in the cylinder communicating with an axial key passage of the cylinder, wherein said pins are mechanically driven in translation by the key along their longitudinal axis and in rotation about said axis and are each a unitary member which is permanently engaged in a housing of the cylinder and in a housing of the body, the pin housings formed in the body being interconnected by an annular path in which pass the pins when the cylinder is rotating, said annular path being formed with projections or contractions adapted for cooperating with cut-outs in the pins.

2. A lock according to claim 1, wherein the pins are different from each other only by the position of said cut-outs.

3. A lock according to claim 1, wherein, the cut-outs are angularly and longitudinally off-set from a pin to the other.

4. A lock according to claim 1, wherein the rotation angle of a pin is between −180° and +180°, or between −90° about and +90° about.

5. A lock according to claim 1, wherein each pin is surrounded by a return spring one end of which is rigidly connected to the pin and the other end of which is rigidly connected to the cylinder.

6. A lock according to claim 1, wherein the ends of the pins are provided with means preventing them from coming out from their housings formed in the body.

7. A lock according to claim 1, wherein the pins are oriented parallel to the cylinder rotation axis.

8. A lock according to claim 1, wherein the pins are oriented radially relative to the cylinder rotation axis and wherein their axes are in the same plane perpendicularly to said rotation axis.

9. A lock according to claim 7, wherein the end portion of each pin, situated into the housing formed in the cylinder, comprises a helical groove formed in its cylindrical peripheral surface and ending into a flared out portion opening at the end face of the pin oriented towards the inlet for the lock key.

10. A lock according to claim 9, wherein the helical groove extends over at least 180° about the pin axis.

11. A lock according to claim 9, wherein the helical groove of each pin is adapted for receiving a radial stud of the key which drives the pin in rotation about its longitudinal axis and is formed in front of a radial shoulder of a key bit, adapted for abutting against the end face of the pin and to displace it in translation when said key is introduced into the lock.

12. A lock according to claim 9, wherein each pin comprises two diametrically opposite cut-outs, formed at its periphery by two transverse grooves bounded each by two parallel side faces and by a curved bottom parallel to the annular path wall oppposite which said bottom is caused to move when the cylinder is rotating.

13. A lock according to claim 12, wherein the curved bottom of one of said transverse grooves is concave, and the curved bottom of the other transverse groove is convex.

14. A lock according to claim 8, wherein the end of each pin oriented towards the key passage comprises an eccentric stud parallel to the pin axis and adapted for being engaged into a longitudinal groove of the key when said key is introduced into the lock.

15. A lock according to claim 14, wherein the bottom of each key groove comprises an oblique portion inclined relative to the key axis and starting from the key end frontal face, and another portion parallel to the key axis.

16. A lock according to claim 14, wherein each key groove comprises a first rectilinear portion parallel to the key axis, starting from the frontal end of the key and ending into a second portion the axis of which forms a predetermined angle with the angle of the first portion.

17. A lock according to claim 14, wherein each pin is formed with two diametrically opposite cut-outs, formed by two transverse grooves each bounded by two parallel side faces and by a bottom.

18. A lock according to claim 17, wherein one of the side walls of the grooves is convex and the other concave, and the bottom is flat.

19. A key for a lock according to claim 1, and comprising a substantially cylindrical body or end-piece, the periphery of which is formed with protruding radial studs, each in longitudinal alignment with a shoulder or key bit.

20. A key according to claim 19, wherein the studs are situated at the same distance from the key longitudinal axis and are longitudinally off-set relative to each other, the shoulders or key bits associated with the studs being also longitudinally off-set relative to each other.

21. A key according to claim 19, wherein the key body is tubular.

22. A key for a lock according to claim 1, and comprising a cylindrical body in the peripheral surface of which are formed longitudinal grooves one flared end of which opens at the front end face of the key and the other end of which extends obliquely relative the key longitudinal axis, the bottoms of said other ends of the grooves being at different distances of the key axis.

* * * * *